US011910844B2

(12) United States Patent
Wu

(10) Patent No.: US 11,910,844 B2
(45) Date of Patent: Feb. 27, 2024

(54) CHEST BINDER

(71) Applicant: Qiuli Wu, Shenzhen (CN)

(72) Inventor: Qiuli Wu, Shenzhen (CN)

( * ) Notice: Subject to any disclaimer, the term of this patent is extended or adjusted under 35 U.S.C. 154(b) by 0 days.

(21) Appl. No.: 18/448,993

(22) Filed: Aug. 14, 2023

(65) Prior Publication Data

US 2023/0380517 A1 Nov. 30, 2023

(30) Foreign Application Priority Data

Sep. 26, 2022 (CN) ..... 202222549419.5

(51) Int. Cl.
*A41C 3/00* (2006.01)

(52) U.S. Cl.
CPC ..... *A41C 3/005* (2013.01); *A41C 3/0028* (2013.01)

(58) Field of Classification Search
CPC ..... A41C 3/005; A41C 3/0028; A41C 1/12; A41C 1/0064; A41C 1/144
See application file for complete search history.

(56) References Cited

U.S. PATENT DOCUMENTS 4,187,855 A * 2/1980 Paulus ..... A61F 2/12 2/104
5,152,741 A * 10/1992 Farnio ..... A61F 13/145 602/61
6,390,885 B1 * 5/2002 Brooks ..... A41C 3/0064 450/3
6,394,879 B1 * 5/2002 Paige ..... A41C 3/04 450/38
2004/0002288 A1 * 1/2004 Bell ..... A61F 5/03 450/75
2013/0252512 A1 * 9/2013 Haley ..... A41C 3/0064 450/58
2014/0045967 A1 * 2/2014 Thomas ..... A61L 27/44 523/105
2014/0295734 A1 * 10/2014 Shashy ..... A41C 3/0057 450/58
2016/0374405 A1 12/2016 Washington et al.
2018/0332905 A1 * 11/2018 Stephens ..... A41C 3/0064
2019/0082760 A1 * 3/2019 Weispfennig ..... A41C 3/00
2021/0186125 A1 * 6/2021 Lee ..... A41C 3/0021
2023/0000179 A1 1/2023 Prochner
2023/0088253 A1 3/2023 Guo

* cited by examiner

*Primary Examiner* — Gloria M Hale
(74) *Attorney, Agent, or Firm* — Zhigang Ma

(57) ABSTRACT

The present disclosure discloses a chest binder. The chest binder includes a chest binder body, wherein a neck opening and sleeve openings are formed on the chest binder body. The chest binder body includes a front piece, a rear piece, and two side pieces. The two side pieces are connected between the front piece and the rear piece. The two side pieces include a left side piece and a right side piece. The left side piece and the right side piece are both located at an axilla positions of the sleeve openings. At least one of the left side piece and the right side piece is provided with an opening for girding and a girding zipper. The girding zipper is arranged at the opening for girding and the girding zipper is used for opening or closing the opening for girding to adjust the chest circumference of the chest binder body.

19 Claims, 7 Drawing Sheets

CHEST BINDER

CROSS-REFERENCE TO RELATED APPLICATIONS

The application claims priority of Chinese patent application CN202222549419.5, filed on Sep. 26, 2022, which is incorporated herein by reference in its entireties.

TECHNICAL FIELD

The present disclosure relates to the field of clothing, in particular, to a chest binder.

BACKGROUND

With the evolving development of social culture, the perception of breast protrusion varies among women. Some women prefer a flatter chest and dresses that conceal the prominence of their breasts, aiming to minimize their appearance. This is particularly relevant for athletes, as excessive breast movement during physical activities can negatively impact their performance. Therefore, there is a demand for an effective solution to securely and comfortably restrain women's breasts, without adding bulk or discomfort.

Currently, there exist chest binders with straps or pieces that need to be fully opened to put on or take off. However, these designs have certain drawbacks. The chest binders with fully opened pieces can easily become unbuckled, compromising their ability to provide adequate support. On the other hand, chest binders with straps on one side are cumbersome to wear and inconvenient to put on or take off. Additionally, some chest binders use adhesive straps on only one side, leading to somatosensory imbalances and discomfort.

In response to the increasing demand for an improved chest binder, especially among individuals experiencing breast-related anxiety, particularly larger-breasted women, we propose a novel approach in the form of a new breast support apparatus. Our chest Binder is designed to address the limitations of existing solutions by providing a new and more user-friendly approach to chest binding. The primary objective is to offer a comfortable and easily adjustable alternative, allowing users to wear and remove the binder effortlessly. With our unique design, wearers can adjust the size and compression level during use without the need to remove the garment, enabling them to take breaks or make necessary adjustments discreetly.

In summary, our invention excels in providing exceptional breast flattening effects, catering to the preferences of different users and, in particular, offering a superior solution for those with larger breasts.

SUMMARY

The present disclosure introduces a novel and improved chest binder, specifically designed to address the deficiencies observed in the prior art. By meticulously identifying and overcoming these limitations, the new chest binder presented herein represents a significant advancement in the field. Its innovative features and unique design set it apart from conventional solutions, offering enhanced functionality and user experience. Through this disclosure, we seek to provide a comprehensive and effective chest binding solution that caters to the diverse needs of users, thereby advancing the state of the art in chest binder technology.

The technical problem at hand is effectively addressed by the innovative solution presented in the current disclosure, which comprises a novel chest binder design. The chest binder consists of a body featuring a neck opening and sleeve openings. Within this body, a front piece, a rear piece, and two side pieces are integrated, with the two side pieces serving as connectors between the front and rear sections. These side pieces, namely the left side piece and the right side piece, are strategically positioned at an axilla positions of the sleeve openings.

The distinctive feature of this chest binder lies in its enhanced adjustability, facilitated by the presence of at least one opening for girding within either the left side piece or the right side piece. Furthermore, the inclusion of a girding zipper situated at the opening enables easy manipulation of the chest circumference of the binder. This zipper mechanism grants users the flexibility to conveniently open or close the girding opening, enabling precise and personalized adjustment of the chest binder's fit to the user's desired comfort level.

Further, the left side piece and the right side piece of the chest binder are each equipped with a first top edge and a first bottom edge. The opening for girding, located on two side edges, possesses a second top edge and a second bottom edge. Notably, the first top edges of both the left side piece and the right side piece are skillfully integrated into the axilla positions of the sleeve openings, ensuring optimal positioning and functionality.

Extending downwards from the axilla position of the sleeve openings, the opening for girding spans to a lower portion of the chest binder body. Consequently, the opening for girding is strategically positioned between the first top edge and the first bottom edge of either the left side piece or the right side piece. This astute design element facilitates seamless adjustability and effective chest binding, creating a secure and comfortable fit for the user.

Further, a distance between the second top edge and the second bottom edge is 60% to 80% of a distance between the first top edges and the first bottom edges of the left side piece and the right side piece.

Further, the distance between the second top edge and the second bottom edge on the two side edges of the opening for girding is 70% of the distance between the first top edges and the first bottom edges of the left side piece and the right side piece.

Further, a distance between the first top edges and the first bottom edges of the left side piece and the right side piece is 13 to 45 CM.

Further, a distance between the second top edge on the two side edges of the opening for girding and the first top edge of the left side piece or the right side piece is 0.5 to 5 CM; and a distance between the second bottom edge on the two side edges of the opening for girding and the first bottom edge of the left side piece or the right side piece is 0.5 to 5 CM.

Further, a distance between the second top edge and the second bottom edge on the two side edges of the opening for girding is 12 to 44 CM.

Further, a protection sheet is arranged at the opening for girding; and one end of the protection sheet is connected to one side edge of the opening for girding, and the other end is connected to the other side edge of the opening for girding, so that the protection sheet is able to block the opening for girding.

Further, a distance between a top of the protection sheet and a bottom of the protection sheet is greater than or equal to the distance between the second top edge and the second bottom edge on the two side edges of the opening for girding.

Further, the protection sheet is an elastic fabric protection sheet.

Further, the front piece includes an outer piece and an inner piece; the outer piece and the inner piece are stacked; and pads are arranged between the outer piece and the inner piece.

Further, first sewing threads that are wavy are arranged at edges of the neck opening and the sleeve openings; and second sewing threads that are wavy are arranged at lower portions of the front piece, the rear piece, and the two side pieces.

The present disclosure also provides a chest binder, The chest binder includes a chest binder body, wherein a neck opening and sleeve openings are formed on the chest binder body; the chest binder body is provided with an opening for girding; a girding zipper is arranged at the opening for girding; the girding zipper is used for opening or closing the opening for girding to adjust the chest circumference of the chest binder body; the opening for girding has a second top edge and a second bottom edge on two side edges; a first clearance exists between the second top edge and a top edge of the chest binder body; and a second clearance exists between the second bottom edge and a bottom edge of the chest binder body.

Further, the chest binder body includes a front piece, a rear piece, and two side pieces; the two side pieces are connected between the front piece and the rear piece; the two side pieces include a left side piece and a right side piece; the left side piece and the right side piece are both located at the axilla positions of the sleeve openings; the left side piece and the right side piece are both provided with the openings for girding; each of the left side piece and the right side piece is provided with a first top edge and a first bottom edge; the first clearance exists between the second top edge and the first top edge; and the second clearance exists between the second bottom edge and the first bottom edge.

Further, a distance between the second top edge on the two side edges of the opening for girding and the first top edge of the left side piece or the right side piece is 0.5 to 5 CM; and a distance between the second bottom edge on the two side edges of the opening for girding and the first bottom edge of the left side piece or the right side piece is 0.5 to 5 CM.

Further, the girding zipper includes a first zipper piece, a second zipper piece and a slider; the first zipper piece is arranged on one side edge of the opening for girding; the second zipper piece is arranged on the other side edge of the opening for girding; and the slider is clamped between the first zipper piece and the second zipper piece.

Further, a protection sheet is arranged at the opening for girding; and one end of the protection sheet is connected to one side edge of the opening for girding, and the other end is connected to the other side edge of the opening for girding, so that the protection sheet is able to block the opening for girding.

Further, the protection sheet is arranged on one side of the opening for girding that faces the chest binder.

Further, the protection sheet is an elastic fabric protection sheet, and the chest binder body is an elastic fabric chest binder body.

Further, the front piece includes an outer piece and an inner piece; the outer piece and the inner piece are stacked; and pads are arranged between the outer piece and the inner piece.

Further, first sewing threads that are wavy are arranged at edges of the neck opening and the sleeve openings; and second sewing threads that are wavy are arranged at lower portions of the front piece, the rear piece, and the two side pieces.

Beneficial effects: the present disclosure unveils a novel chest binder that brings forth several noteworthy advantages. The chest binder comprises a chest binder body, featuring a neck opening and sleeve openings, and includes a front piece, a rear piece, and two side pieces, with the latter serving as connectors between the front and rear sections. These side pieces, consisting of a left side piece and a right side piece, are strategically located at the axilla positions of the sleeve openings.

A key aspect of the chest binder's innovation lies in the inclusion of at least one opening for girding on either the left side piece or the right side piece. This opening, complemented by a girding zipper, enables users to effortlessly adjust the chest circumference of the binder. By simply operating the girding zipper to open the opening for girding, wearers can relieve any tightness and adjust the girding distance between the two side edges of the opening. This facilitates easy donning of the chest binder, ensuring maximum comfort.

Once the wearer has put on the chest binder, they can operate the girding zipper to close the opening for girding, effectively fine-tuning the girding distance between the two side edges. This results in the chest binder fitting snugly to the wearer's body, achieving an optimal girding effect. Notably, the chest binder remains secure and steadfast throughout wear, without the risk of loosening. The user-friendly design of the girding zipper ensures effortless and convenient operation throughout the process.

Furthermore, the placement of the opening for girding and the girding zipper on the two side pieces at an axilla positions of the sleeve openings offers distinct advantages. Compared to the front and rear pieces, this arrangement renders the opening for girding and the girding zipper more discreet and less visible, significantly enhancing the overall attractiveness of the chest binder. Moreover, the act of operating the girding zipper further adds to the overall aesthetic appeal of the product. In conclusion, the disclosed chest binder showcases numerous beneficial effects, including enhanced adjustability, ease of wear, secure girding, and improved aesthetics. These collective features contribute to positioning our invention as a highly advantageous and aesthetically appealing solution in the field of chest binding technology, promising an improved user experience and increased customer satisfaction.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Embodiment I

Figure 1:
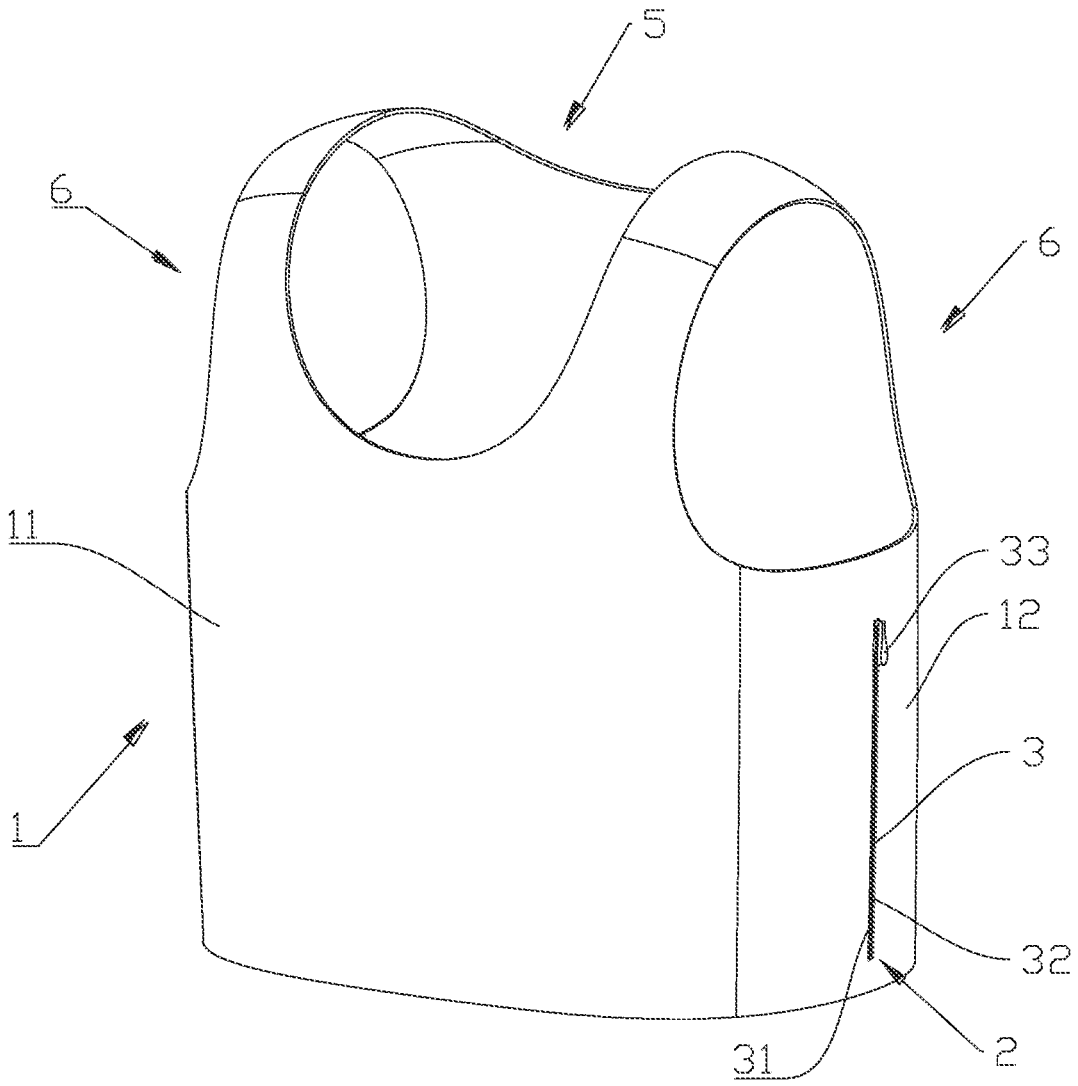
FIG. 1 is a schematic structural diagram of a laced state of the present disclosure.
Figure 2:
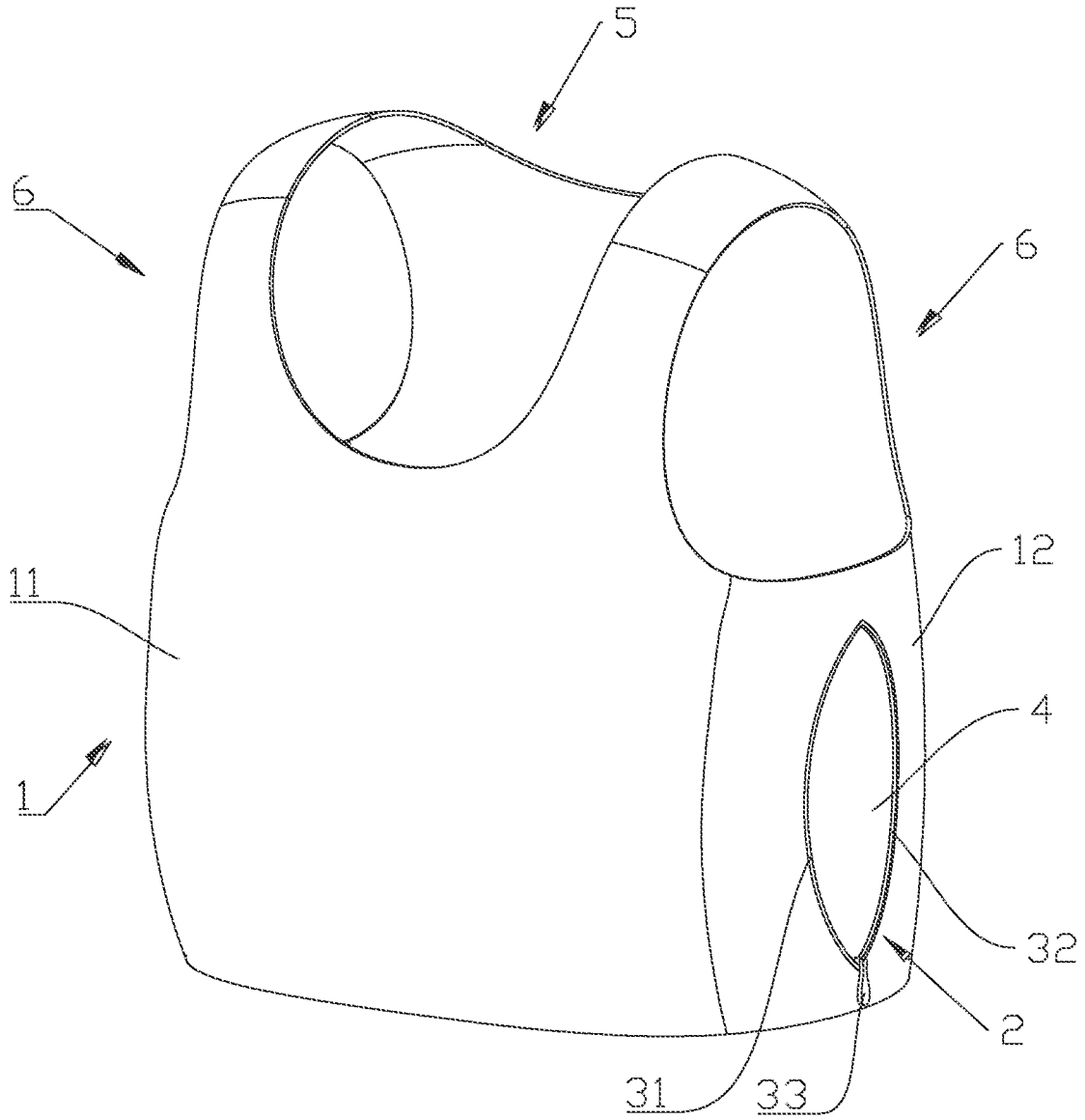
FIG. 2 is a schematic structural diagram of a loose state of the present disclosure.
Figure 3:
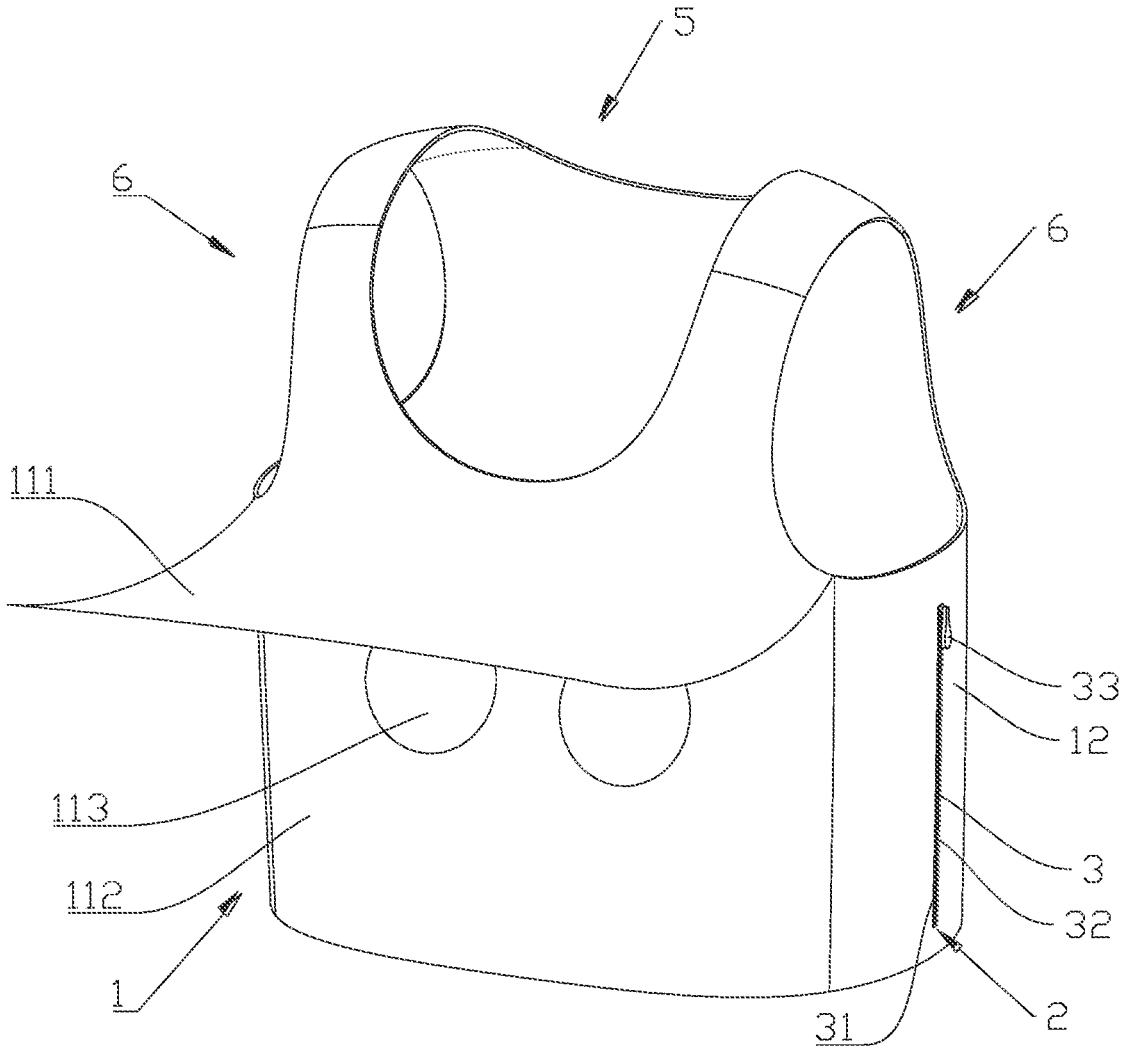
FIG. 3 is a schematic structural diagram showing that an outer piece is opened in the present disclosure.
Figure 4:
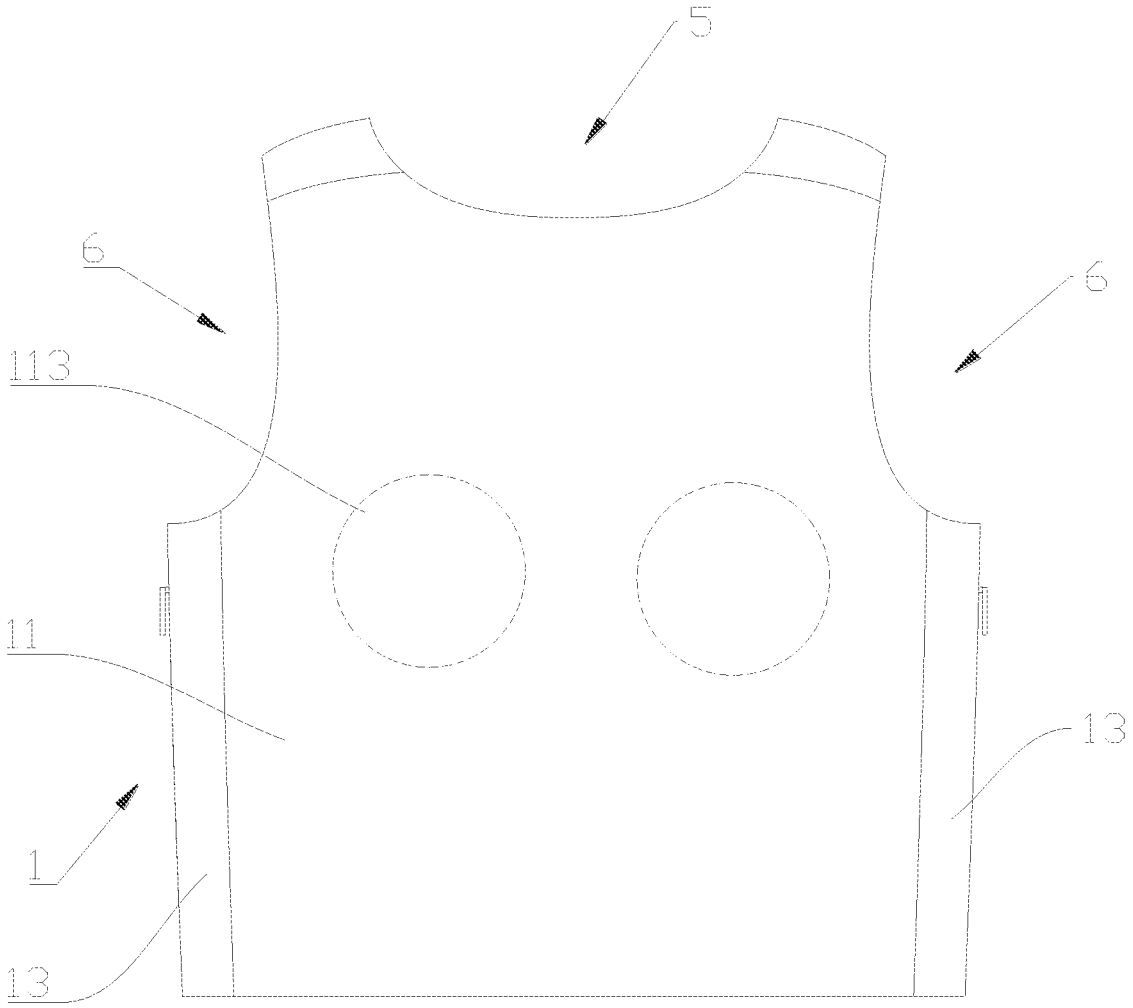
FIG. 4 is an orthographic projection of a front piece of the present disclosure.
Figure 5:
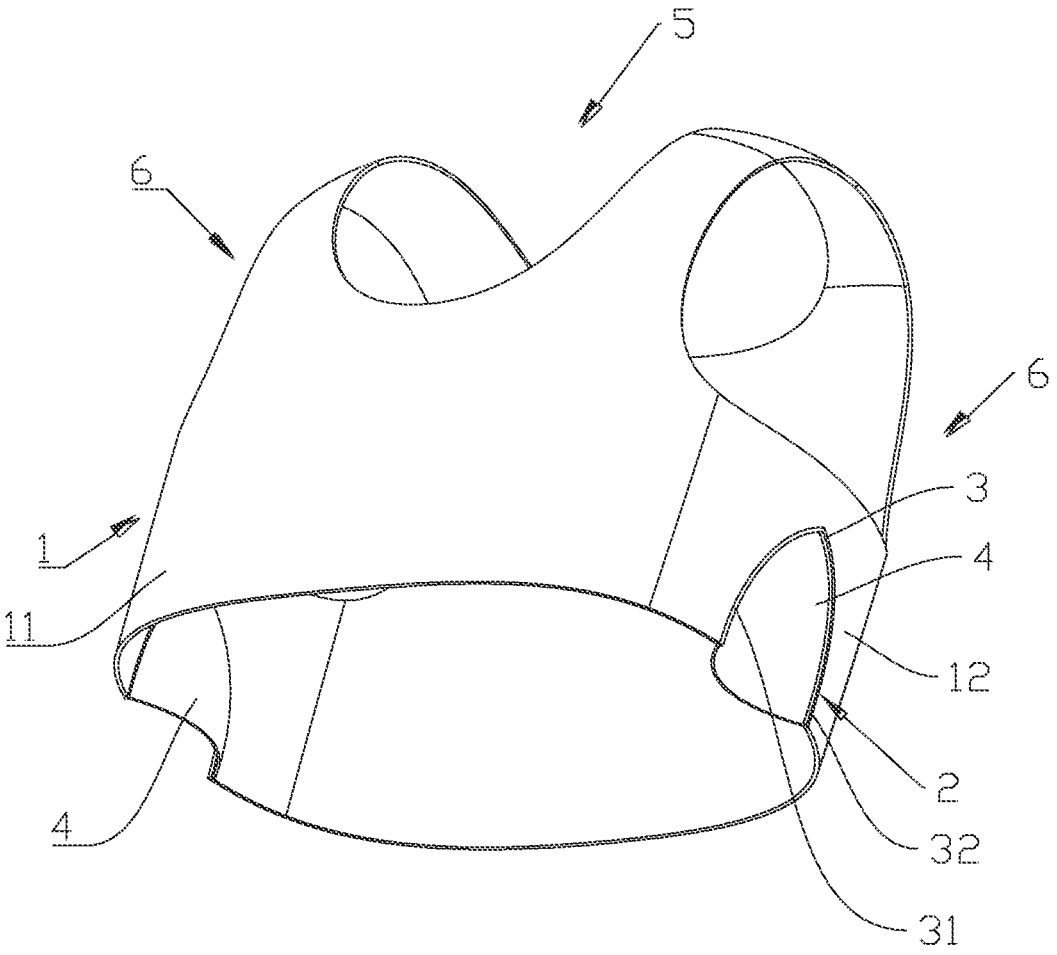
FIG. 5 is a sectional view of a loose state of the present disclosure.
Figure 6:
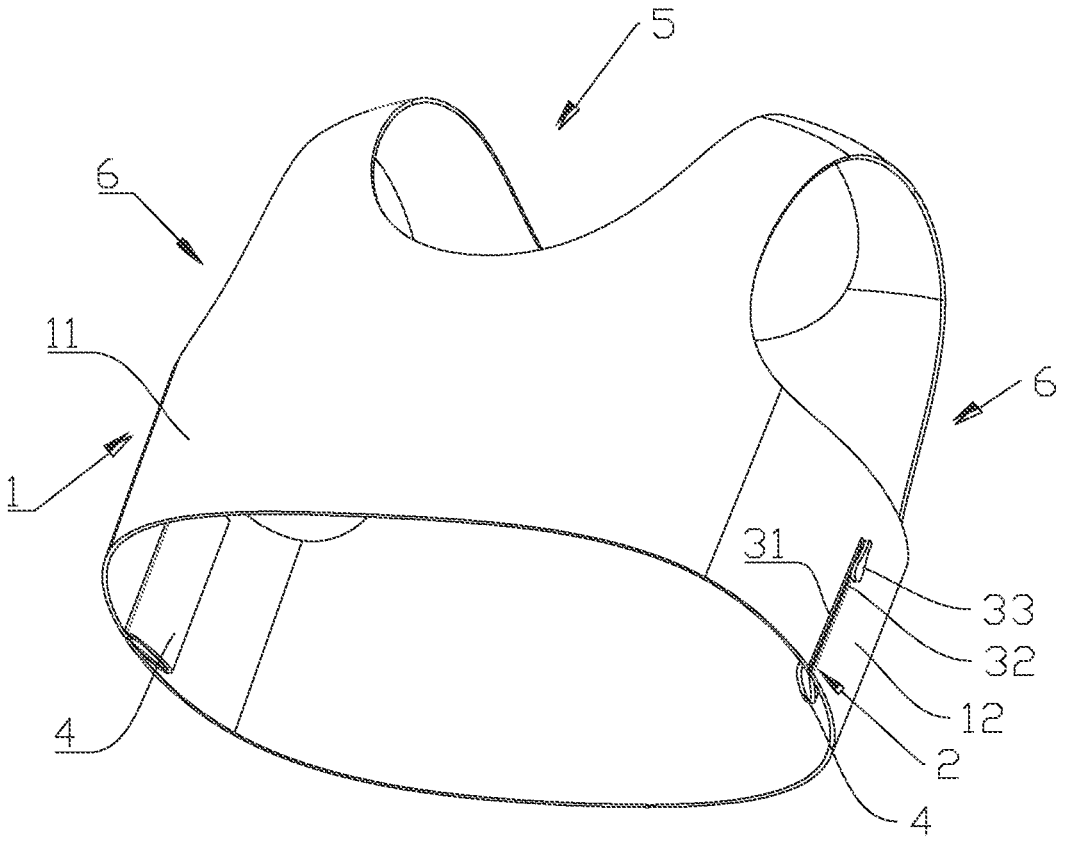
FIG. 6 is a sectional view of a laced state of the present disclosure.

Referring to FIG. 1 to FIG. 7, a chest binder includes: a chest binder body 1, wherein a neck opening 5 and sleeve openings 6 are formed on the chest binder body 1; the chest binder body 1 includes a front piece 11, a rear piece 12, and two side pieces 13; the two side pieces 13 are connected between the front piece 11 and the rear piece 12; the two side pieces 13 comprise a left side piece 131 and a right side piece 132; the left side piece 131 and the right side piece 132 are both located at an axilla positions of the sleeve openings; at least one of the left side piece 131 and the right side piece 132 is provided with an opening 2 for girding; and a girding zipper 3, wherein the girding zipper 3 is arranged at the opening 2 for girding; and the girding zipper 3 is used for opening or closing the opening 2 for girding to adjust the chest circumference of the chest binder body 1.

Through the carefully devised structural arrangement as described above, at least one of the left side piece and the right side piece of the chest binder body is equipped with an opening for girding, with the girding zipper thoughtfully positioned at the opening for girding. This ingenious design enables the girding zipper to easily open or close the girding opening, thereby providing a means to adjust the chest circumference of the chest binder body.

To don the chest binder, the wearer simply operates the girding zipper to open the opening for girding, alleviating any tightness and allowing for adjustment of the girding distance between the two side edges of the opening. This facilitates easy wearing of the chest binder as it achieves the largest chest circumference, providing convenience to the wearer. Once the wearer has put on the chest binder, they can utilize the girding zipper to close the opening for girding, expertly tailoring the girding distance between the two side edges to attain the smallest chest circumference, ensuring an optimal girding effect. Importantly, the chest binder remains secure throughout wear, minimizing any likelihood of loosening and ensuring a hassle-free experience for the wearer.

Furthermore, the strategic placement of the opening for girding and the girding zipper on the two side pieces, situated at the axilla positions of the sleeve openings, offers distinctive advantages. This arrangement renders the opening for girding and the girding zipper less conspicuous compared to positioning them on the front and rear pieces, thus enhancing the overall attractiveness of the chest binder. Additionally, the operation of the girding zipper contributes to an enhanced visual appeal, further adding to the product's overall beauty and user-friendliness.

Further, each of the left side piece 131 and the right side piece 132 is provided with a first top edge 7 and a first bottom edge 71; the opening 2 for girding has a second top edge 72 and a second bottom edge 73 on two side edges; the first top edges 7 of the left side piece 131 and the right side piece 132 are connected to the axilla positions of the sleeve opening 6; and the opening 2 for girding downwards extends from the axilla position of the sleeve opening 6 to a lower portion of the chest binder body 1, so that the opening for girding is arranged between the first top edge 7 and the first bottom edge 71 of the left side piece 131 or the right side piece 132. A distance between the second top edge 72 and the second bottom edge 73 is 60% to 80% of a distance between the first top edges 7 and the first bottom edges 71 of the left side piece 131 and the right side piece 132. Specifically, the distance between the second top edge 72 and the second bottom edge 73 on the two side edges of the opening 2 for girding is 70% of the distance between the first top edges 7 and the first bottom edges 71 of the left side piece 131 and the right side piece 132. Further, a distance between the first top edges 7 and the first bottom edges 71 of the left side piece 131 and the right side piece 132 is 13 to 45 CM. Much further, a distance between the second top edge 72 on the two side edges of the opening 2 for girding and the first top edge 7 of the left side piece 131 or the right side piece 132 is 0.5 to 5 CM; and a distance between the second bottom edge 73 on the two side edges of the opening 2 for girding and the first bottom edge 71 of the left side piece 131 or the right side piece 132 is 0.5 to 5 CM. Much further, a distance between the second top edge 72 and the second bottom edge 73 on the two side edges of the opening 2 for girding is 12 to 44 CM. By means of the above structure, the opening for girding and the girding zipper are effectively arranged, so that the girding effect of the chest binder is better.

In this embodiment, a protection sheet 4 is arranged at the opening 2 for girding; and one end of the protection sheet 4 is connected to one side edge of the opening 2 for girding, and the other end is connected to the other side edge of the opening 2 for girding, so that the protection sheet 4 can block the opening 2 for girding. A distance between a top of the protection sheet 4 and a bottom of the protection sheet 4 is greater than or equal to the distance between the second top edge 72 and the second bottom edge 73 on the two side edges of the opening 2 for girding. Further, the protection sheet 4 is an elastic fabric protection sheet. By means of the above structural arrangement, when the wearer unzips the girding zipper 3, the protection sheet can help restrain the maximum distance between the two sides of the opening for girding to avoid the chest binder from being broken from the opening for girding by an excessive pulling force. After the chest binder is put on, the protection sheet is located in the opening for girding. The protection sheet can prevent the girding zipper from being in direct contact with the skin of the wearer to cause discomfort. Furthermore, the elastic fabric protection sheet has certain retractility. The user can also easily put on the chest binder even if the chest binder is small, and the user will not feel discomfortable during exercise.

In this embodiment, the front piece 11 includes an outer piece 111 and an inner piece 112. The outer piece 111 and the inner piece 112 are stacked. Pads 113 are arranged between the outer piece 111 and the inner piece 112. By means of the above structural arrangement, the pads can avoid prominence of private parts of the wearer and better protect the privacy of the wearer. The pads 113 are round thin sheets, which are arranged at positions corresponding to wearer's breasts when the wearer wears the chest binder. By means of the above structural arrangement, the round thin pads fit wearer's breasts during wearing to improve the wearing comfort level.

Figure 7:
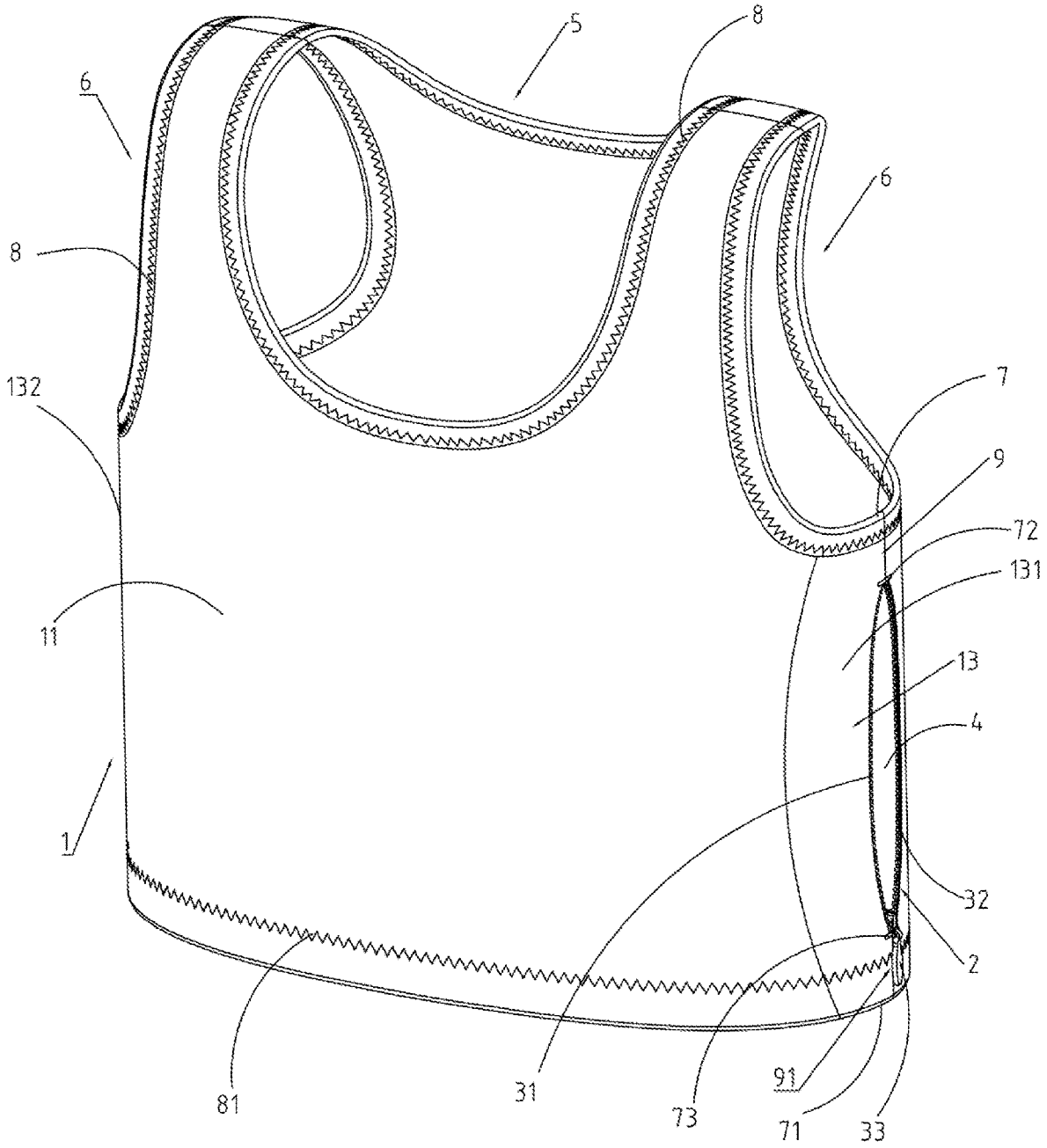
FIG. 7 is a schematic diagram of a first sewing thread, a second sewing thread, a first top edge, a first bottom edge, a second top edge, a second bottom edge, a first clearance, and a second clearance.

Referring to FIG. 7, first sewing threads 8 that are wavy are arranged at edges of the neck opening 5 and the sleeve openings 6; and second sewing threads 81 that are wavy are arranged at lower portions of the front piece 11, the rear piece 12, and the two side pieces 13. By means of the above structure, the wavy first sewing threads and the wavy second sewing threads are attractive, and the sewing strength of the sewing threads are higher than that of straight sewing threads.

Embodiment II

Referring to FIG. 1 to FIG. 7, a chest binder includes a chest binder body 1. A neck opening 5 and sleeve openings 6 are formed on the chest binder body 1. The chest binder body 1 is provided with an opening 2 for girding. A girding zipper 3 is arranged at the opening 2 for girding. The girding zipper 3 is used for opening or closing the opening 2 for girding to adjust the chest circumference of the chest binder body 1. The opening 2 for girding has a second top edge 72 and a second bottom edge 73 on two side edges. A first clearance 9 exists between the second top edge 72 and a top edge of the chest binder body 1. A second clearance 91 exists between the second bottom edge 73 and a bottom edge of the chest binder body 1. By means of the above structure, the first clearance 9 exists between the second top edge 72 and the top edge of the chest binder body 1, and the second clearance 91 exists between the second bottom edge 73 and the bottom edge of the chest binder body 1, which can effectively prevent the girding zipper from being excessively pulled and prevent the girding zipper from being separated from the top edge and the bottom edge of the chest binder body.

In this embodiment, the chest binder body 1 includes a front piece 11, a rear piece 12, and two side pieces 13; the two side pieces 13 are connected between the front piece 11 and the rear piece 12; the two side pieces 13 include a left side piece 131 and a right side piece 132; the left side piece 131 and the right side piece 132 are both located at the axilla positions of the sleeve opening 6; the left side piece 131 and the right side piece 132 are both provided with the openings 2 for girding; each of the left side piece 131 and the right side piece 132 is provided with a first top edge 7 and a first bottom edge 71; the first clearance 9 exists between the second top edge 72 and the first top edge 7; and the second clearance 91 exists between the second bottom edge 73 and the first bottom edge 71. Much further, a distance between the second top edge 72 on the two side edges of the opening 2 for girding and the first top edge 7 of the left side piece 131 or the right side piece 132 is 0.5 to 5 CM; and a distance between the second bottom edge 73 on the two side edges of the opening 2 for girding and the first bottom edge 71 of the left side piece 131 or the right side piece 132 is 0.5 to 5 CM. By means of the above structure, the chest binder has a reasonable design, simple structure, and stable connection, and effectively sets the first clearance and the second clearance.

In this embodiment, the girding zipper 3 includes a first zipper piece 31, a second zipper piece 32 and a slider 33. The first zipper piece 31 is arranged on one side edge of the opening 2 for girding. The second zipper piece 32 is arranged on the other side edge of the opening 2 for girding. The slider 33 is clamped between the first zipper piece 31 and the second zipper piece 32. By means of the above structure, the first zipper piece and the second zipper piece are respectively fixed on the openings for girding. The slider is pulled to achieve a tight state and a loose state of the openings for girding. By the above structural arrangement, to wear the chest binder, the wearer pulls the slider to switch the tight state and the loose state of the openings for girding to avoid strap adhesion or inconvenient wearing of straps.

Further, a protection sheet 4 is arranged at the opening 2 for girding; and one end of the protection sheet 4 is connected to one side edge of the opening 2 for girding, and the other end is connected to the other side edge of the opening 2 for girding, so that the protection sheet 4 can block the opening 2 for girding. The protection sheet 4 is arranged on one side, facing the chest binder body 1, of the opening 2 for girding. By means of the above structure, when the wearer unzips the girding zipper 3, the protection sheet can help restrain the maximum distance between the two sides of the opening for girding to avoid the chest binder from being broken from the opening for girding by an excessive pulling force. After the chest binder is put on, the protection sheet is located in the opening for girding. The protection sheet can prevent the girding zipper from being in direct contact with the skin of the wearer to cause discomfort.

In this embodiment, the protection sheet 4 is an elastic fabric protection sheet, and the chest binder body 1 is an elastic fabric protection sheet. By means of the above structure, the elastic fabric protection sheet has certain retractility. The user can also easily put on the chest binder even if the chest binder is small, and the user will not feel discomfortable during exercise.

In this embodiment, the front piece 11 includes an outer piece 111 and an inner piece 112. The outer piece 111 and the inner piece 112 are stacked. Pads 113 are arranged between the outer piece 111 and the inner piece 112. By means of the above structural arrangement, the pads can avoid prominence of private parts of the wearer and better protect the privacy of the wearer. The pads 113 are round thin sheets, which are arranged at positions corresponding to wearer's breasts when the wearer wears the chest binder. By means of the above structural arrangement, the round thin pads fit wearer's breasts during wearing to improve the wearing comfort level.

Referring to FIG. 7, in this embodiment, first sewing threads 8 that are wavy are arranged at edges of the neck opening 5 and the sleeve openings 6; and second sewing threads 81 that are wavy are arranged at lower portions of the front piece 11, the rear piece 12, and the two side pieces 13. By means of the above structure, the wavy first sewing threads and the wavy second sewing threads are attractive, and the sewing strength of the sewing threads are higher than that of straight sewing threads.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A chest binder, comprising a chest binder body, wherein a neck opening and sleeve openings are formed on the chest binder body; the chest binder body comprises a front piece, a rear piece, and two side pieces; the two side pieces are connected between the front piece and the rear piece; the two side pieces comprise a left side piece and a right side piece; the left side piece and the right side piece are both located at an axilla positions of the sleeve openings; at least one of the left side piece and the right side piece is provided with an opening for girding; and a girding zipper, wherein the girding zipper is arranged at the opening for girding; and the girding zipper is used for opening or closing the opening for girding to adjust the chest circumference of the chest binder body;

wherein a distance between the second top edge and the second bottom edge on the two side edges of the opening for girding is 12 to 44 CM.

2. The chest binder according to claim 1, wherein each of the left side piece and the right side piece is provided with a first top edge and a first bottom edge; the opening for girding has a second top edge and a second bottom edge on two side edges; the first top edges of the left side piece and the right side piece are connected to the axilla positions of the sleeve openings; and the opening for girding downwards extends from the axilla position of the sleeve openings to a lower portion of the chest binder body, so that the opening for girding is arranged between the first top edge and the first bottom edge of the left side piece or the right side piece.

3. The chest binder according to claim 2, wherein a distance between the second top edge and the second bottom edge is 60% to 80% of a distance between the first top edges and the first bottom edges of the left side piece and the right side piece.

4. The chest binder according to claim 3, wherein the distance between the second top edge and the second bottom edge on the two side edges of the opening for girding is 70% of the distance between the first top edges and the first bottom edges of the left side piece and the right side piece.

5. The chest binder according to claim 2, wherein a distance between the first top edges and the first bottom edges of the left side piece and the right side piece is 13 to 45 CM.

6. A chest binder, comprising a chest binder body, wherein a neck opening and sleeve openings are formed on the chest binder body; the chest binder body comprises a front piece, a rear piece, and two side pieces; the two side pieces are connected between the front piece and the rear piece; the two side pieces comprise a left side piece and a right side piece; the left side piece and the right side piece are both located at an axilla positions of the sleeve opening; at least one of the left side piece and the right side piece is provided with an opening for girding; and a girding zipper, wherein the girding zipper is arranged at the opening for girding; and the girding zipper is used for opening or closing the opening for girding to adjust the chest circumference of the chest binder body;

wherein a distance between the second top edge on the two side edges of the opening for girding and the first top edge of the left side piece or the right side piece is 0.5 to 5 CM; and a distance between the second bottom edge on the two side edges of the opening for girding and the first bottom edge of the left side piece or the right side piece is 0.5 to 5 CM.

7. The chest binder according to claim 2, wherein a protection sheet is arranged at the opening for girding; and one end of the protection sheet is connected to one side edge of the opening for girding, and the other end is connected to the other side edge of the opening for girding, so that the protection sheet is able to block the opening for girding.

8. The chest binder according to claim 7, wherein a distance between a top of the protection sheet and a bottom of the protection sheet is greater than or equal to the distance between the second top edge and the second bottom edge on the two side edges of the opening for girding.

9. The chest binder according to claim 7, wherein the protection sheet is an elastic fabric protection sheet.

10. The chest binder according to claim 1, wherein the front piece comprises an outer piece and an inner piece; the outer piece and the inner piece are stacked; and pads are arranged between the outer piece and the inner piece.

11. A chest binder, comprising a chest binder body, wherein a neck opening and sleeve openings are formed on the chest binder body; the chest binder body is provided with an opening for girding; a girding zipper is arranged at the opening for girding; the girding zipper is used for opening or closing the opening for girding to adjust the chest circumference of the chest binder body; the opening for girding has a second top edge and a second bottom edge on two side edges; a first clearance exists between the second top edge and a top edge of the chest binder body; and a second clearance exists between the second bottom edge and a bottom edge of the chest binder body.

12. The chest binder according to claim 11, wherein the chest binder body comprises a front piece, a rear piece, and two side pieces; the two side pieces are connected between the front piece and the rear piece; the two side pieces comprise a left side piece and a right side piece; the left side piece and the right side piece are both located at the axilla positions of the sleeve openings; the left side piece and the right side piece are both provided with the openings for girding; each of the left side piece and the right side piece is provided with a first top edge and a first bottom edge; the first clearance exists between the second top edge and the first top edge; and the second clearance exists between the second bottom edge and the first bottom edge.

13. The chest binder according to claim 12, wherein a distance between the second top edge on the two side edges of the opening for girding and the first top edge of the left side piece or the right side piece is 0.5 to 5 CM; and a distance between the second bottom edge on the two side edges of the opening for girding and the first bottom edge of the left side piece or the right side piece is 0.5 to 5 CM.

14. The chest binder according to claim 11, wherein the girding zipper comprises a first zipper piece, a second zipper piece and a slider; the first zipper piece is arranged on one side edge of the opening for girding; the second zipper piece is arranged on the other side edge of the opening for girding; and the slider is clamped between the first zipper piece and the second zipper piece.

15. The chest binder according to claim 11, wherein a protection sheet is arranged at the opening for girding; and one end of the protection sheet is connected to one side edge of the opening for girding, and the other end is connected to the other side edge of the opening for girding, so that the protection sheet is able to block the opening for girding.

16. The chest binder according to claim 15, wherein the protection sheet is arranged on one side of the opening for girding that faces the chest binder.

17. The chest binder according to claim 15, wherein the protection sheet is an elastic fabric protection sheet, and the chest binder body is an elastic fabric chest binder body.

18. The chest binder according to claim 12, wherein the front piece comprises an outer piece and an inner piece; the outer piece and the inner piece are stacked; and pads are arranged between the outer piece and the inner piece.

19. The chest binder according to claim 12, wherein first sewing threads that are wavy are arranged at edges of the neck opening and the sleeve openings; and second sewing threads that are wavy are arranged at lower portions of the front piece, the rear piece, and the two side pieces.

* * * * *